US006269756B1

(12) United States Patent
Sachs et al.

(10) Patent No.: US 6,269,756 B1
(45) **Date of Patent: *Aug. 7, 2001**

(54) LIQUID COOLED GRATE PLATE

(75) Inventors: Hans-Ulrich Sachs, Grossbettlingen; Gerhard Heinz, Esslingen; Gerhard Schroth, Stuttgart, all of (DE)

(73) Assignee: Alstom Energy Systems GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/204,963

(22) Filed: Dec. 3, 1998

(30) Foreign Application Priority Data

Dec. 5, 1997 (DE) ..... 197 53 981

(51) Int. Cl.[7] ..... F23H 3/00

(52) U.S. Cl. ..... 110/298; 110/300; 110/328; 126/152 R; 126/163 R

(58) Field of Search ..... 110/267, 268, 110/281, 298, 299, 300, 327, 328; 126/152 R, 163 R

(56) References Cited

U.S. PATENT DOCUMENTS

| | | | | |
|---|---|---|---|---|
| 1,154,717 | * | 9/1915 | Muirhead | 110/299 |
| 1,473,846 | * | 11/1923 | Gibson, Jr. | 110/298 X |
| 1,742,908 | * | 1/1930 | Gibson | 126/152 R |
| 2,745,364 | * | 5/1956 | Martin | 110/298 |
| 4,314,541 | * | 2/1982 | Martin et al. | 110/281 X |
| 4,479,441 | * | 10/1984 | Somodi | 110/298 X |
| 5,673,636 | * | 10/1997 | Stiefel | 110/281 X |
| 5,724,898 | * | 3/1998 | Von Bockh et al. | 110/328 X |
| 5,899,149 | * | 5/1999 | Binner et al. | 126/163 R |
| 5,899,150 | * | 5/1999 | Martin et al. | 110/299 X |
| 5,913,274 | * | 6/1999 | Kunzli et al. | 110/281 X |

FOREIGN PATENT DOCUMENTS

| | | |
|---|---|---|
| 196 13 507 C1 | 8/1997 | (DE) . |
| 0 621 449 B1 | 6/1993 | (EP) . |

* cited by examiner

*Primary Examiner*—Ira S. Lazarus
*Assistant Examiner*—Ljiljana V. Circi
(74) *Attorney, Agent, or Firm*—Alix, Yale & Ristas, LLP

(57) ABSTRACT

A water-coolable grate plate including a top surface, oppositely disposed sides and at least one cooling channel which is thermally connected to the top surface. The cooling channel connects a first coolant port, which is substantially centered between the sides of the grate plate, to a second coolant port, which is positioned at a distance from the first coolant port.

29 Claims, 10 Drawing Sheets

LIQUID COOLED GRATE PLATE

BACKGROUND OF THE INVENTION

This invention relates generally to incinerator grate plates. More particularly, the present invention relates to liquid-cooled incinerator grate plates.

For burning solid materials, especially at trash incinerators, furnaces are used which employ so-called feed grates capable of accepting and feeding the material to be incinerated with a forward motion. These feed grates are composed of bars or plates some of which are mounted in stationary position while groups of others move back and forth, i.e. alternating toward and away from the feed port.

The grate as a whole commonly consists of multiple bars or plates arranged side by side and one behind the other. Slotted nozzles in the bars or plates allow combustion air to flow to the material to be incinerated.

During the incineration process the burning solids cause the grate bars or plates to heat up considerably. The combustion air flowing through the slots, which is usually preheated or limited in quantity for reasons of combustion properties, can provide very little cooling at best. Uncooled grate bars or plates thus reach relatively high temperatures, which tends to cause strong chemical corrosion and physical wear, an obviously undesirable factor.

Strongly heated grate plates expand during operation. Allowing for such expansion requires a certain amount of 'play'. That in turn can create gaps between the grate plates which admit air into the incineration chamber. This air flow is uncontrolled which is again an undesirable factor. Excessive amounts of air also have a negative effect on the combustion process. Smaller particles can drop through the gaps and collect underneath the grate, yet another undesirable factor.

For these two underlying reasons it is desirable to cool grate plates during operation, i.e. to keep them at a constant temperature. To that end, German patent DE 196 13 507 C1 proposes a grate plate that extends across the entire path of the grate. The grate plate incorporates numerous parallel cooling channels which run in the longitudinal direction and lead to manifolds at the end.

This type of grate plate permits effective cooling without requiring an allowance for expansion gaps which would admit an undesirable air flow. Of course, extending across the entire width of the grate, the plate becomes relatively large.

EP 0621449 B1 describes a grate plate with a serpentine cooling channel which latter runs along the horizontal axis of the grate plate and !,thus perpendicular to the feed motion. Due to the meandering course of the cooling channel some sections of the channel extend in the longitudinal direction.

A cooling-water intake on one side and an outlet for the warmed-up cooling water on the other side of the grate plate produces a thermal gradient which can cause different degrees of expansion on the two sides of the grate. Different expansion coefficients in turn can cause the plate to warp and to produce cracks which are substantially wider than the thermal expansion itself. To minimize this effect, a relatively strong coolant flow is necessary. The coolant cannot be allowed to warm up much if a warping or distortion of the grate plate due to thermal expansion differentials is to be avoided. Otherwise, gaps could form between adjoining grate plates, allowing uncontrolled air to enter the combustion chamber and debris to fall through these gaps.

SUMMARY OF THE INVENTION

Briefly stated, the invention in a preferred form is a grate plate incorporating a cooling system which adapts itself to the thermal load on the grate plate.

The grate plate is provided with a cooling channel having a centrally located coolant port (useable as an inlet or an outlet) as contrasted to side ports predominantly used in the prior art. The center location of the port allows for the coolant to be centrally introduced into or removed from the grate plate. From this central point the cooling channel leads to the peripheral sections of the grate plate, supplying the coolant to, and removing it from, these sections.

The coolant warms up as it travels through the cooling channel, producing a thermal gradient along the cooling channel. Consequently, as the grate plate is heated from the top during operation, there will be a thermal gradient from the central port toward the peripheral sections of the plate, or vice versa. In any event, the heat distribution will be more or less symmetric. Depending on the direction of flow of the coolant, the grate plate may be cooled more strongly in the center or along the perimeter. Nevertheless, in relation to a longitudinal center line the temperature distribution will be essentially symmetric. That leads to a marked improvement of the expansion pattern and consequent thermal stress distribution of the grate plate due to focused cooling. This in turn avoids warping and the formation of open gaps between neighboring grate bars or plates or a jamming of movable grate plates. Solid debris can be largely prevented from falling through gaps between grate bars or plates. Moreover, the amount of the cooling water needed can be reduced and thermal differences may be generally higher which again produces a higher temperature of the cooling water, further reducing the amount required.

Central introduction and removal of the coolant makes it possible to cool larger areas of the grate plate so that, even if the perimeter is heated up, the overall thermal expansion is relatively minor. It permits eliminating thermal expansion differentials, keeping the thermal expansion of the grate plate uniformly balanced while minimizing the amount of coolant needed, and reducing thermal stress in the plate metal.

The grate plate disclosed is intended primarily for feeder grates. Accordingly, it is provided at one end with a coupling element allowing it to be connected with a grate-plate carrier such as a round rod or similarly suitable carrying element. At its opposite end the grate plate is provided with a sliding support, for instance a foot that supports it in movable fashion on a suitable countersupport which may be a leading grate plate adjoining in the forward feed direction.

For as long as the coolant port is centered between the two sides of the grate plate, it may be located closer to the sliding support or closer to the coupling element, as dictated by the design. In either case, the thermal gradient will be more or less the same in both lateral directions. It is therefore not necessary for the coolant connecting port to be centered between the forward and the rearward end of the plate, for as long as it is positioned along an imaginary line which is centered between the two sides and connects the forward and rearward ends of the plate. Preferably, the coolant port is positioned somewhat closer to the forward end of the grate plate, so that the distance ratio between it and the ends is one to two. Configuring the intake and outlet of the coolant in this fashion will maintain a sufficiently accurate thermal symmetry while providing slightly greater cooling in the forward section.

A second coolant port may be provided anywhere on the grate plate. In this case, the cooling channel between the central port and the second port, provided at a distance from the first, may be one single channel or it may be subdivided into several subchannels.

The cooling channel may be configured in different ways. For example, it may be constituted of one cavity with several drain ports along the perimeter for discharging the coolant. The intake of the coolant is provided to the central port. It is also possible to make the cooling channel spiral-shaped (round) or to lay it out along a square-corned spiral pattern. If necessary, it may be star-shaped, with subchannels radially extending outward from the central port and connecting, individually or in groups, to additional ports along the plate perimeter.

In all cases, the desired thermal pattern on the surface of the grate plate can be obtained by selecting a suitably adapted cross section of the cooling channel. For example, in the case of a radial star configuration of the subchannels it may be desirable to reduce the diameter of these subchannels in the area near the central port, producing a faster coolant flow rate in that area. This will keep a large central portion of the grate plate relatively cool, minimizing thermal expansion. In the case of a spiral configuration of the cooling channel the heat distribution will be similar. A substantial portion of the overall length of the cooling channel will be in the peripheral area of the grate plate while a correspondingly large section of the cooling channel will occupy several inner spiral loops which together cover a large surface area.

In addition to the coolant port that connects to the central port of the grate plate according to this invention, another cooling channel may be provided, for instance near the sliding support foot. This additional cooling channel can serve to reduce particularly strong thermal exposure in this area, which will be especially desirable if that area contains air slots serving to admit combustion air. It is in this section where the influx of combustion air produces very high temperatures. The combustion air which enters here and aids in the combustion process causes the hot metal of the grate plate to corrode, but cooling will slow the corrosion.

The grate plate may be designed as a single unit or as a multipart composite. A single-unit design can be produced at particularly low cost. An especially practical approach is to install the cooling channel in the form of appropriate pipes and shape the grate plate around them at the time the plate is manufactured by the casting process. This permits the creation of relatively complex cooling-channel patterns without the need for cored dies.

It is an object of the invention to provide a new and improved grate plate which has very little tendency to warp.

It is also an object of the invention to provide a new and improved liquid-cooled grate plate.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

With reference to the drawings wherein like numerals represent like parts throughout the several figures, a grate plate in accordance with the present invention is generally designated by the numeral 3.

Figure 1:
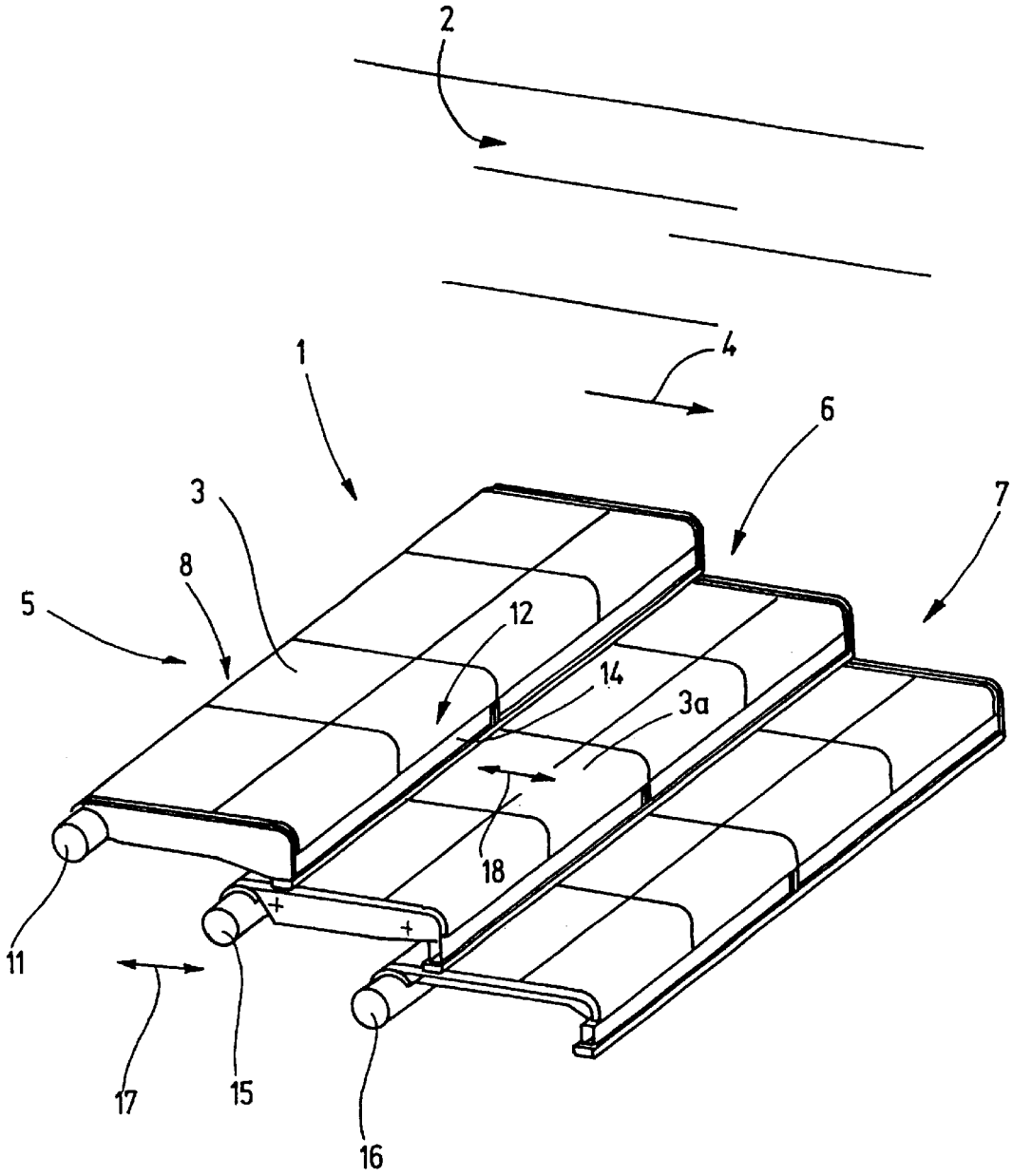
FIG. 1 is a simplified schematic, perspective view of a feed grate consisting of several grate plates in accordance with the invention mounted in the interior of an incinerator.
Figure 2:
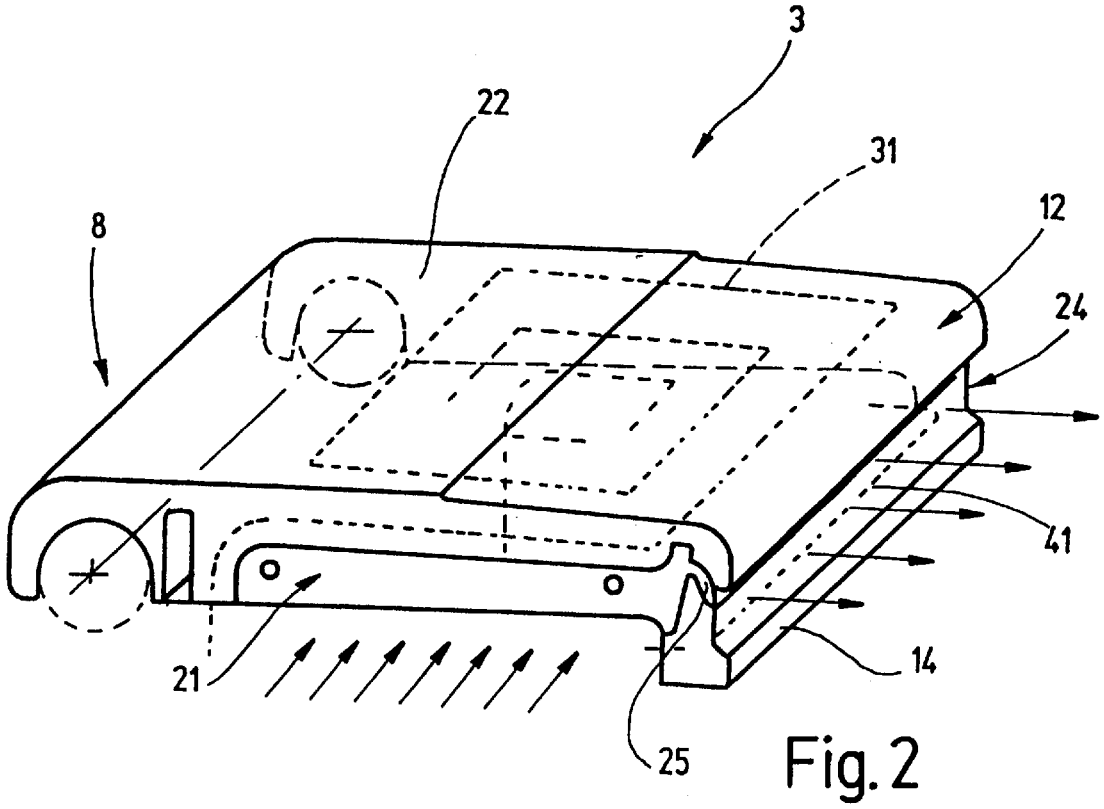
FIG. 2 is a schematic, perspective view of a grate plate of FIG. 1.
Figure 3:
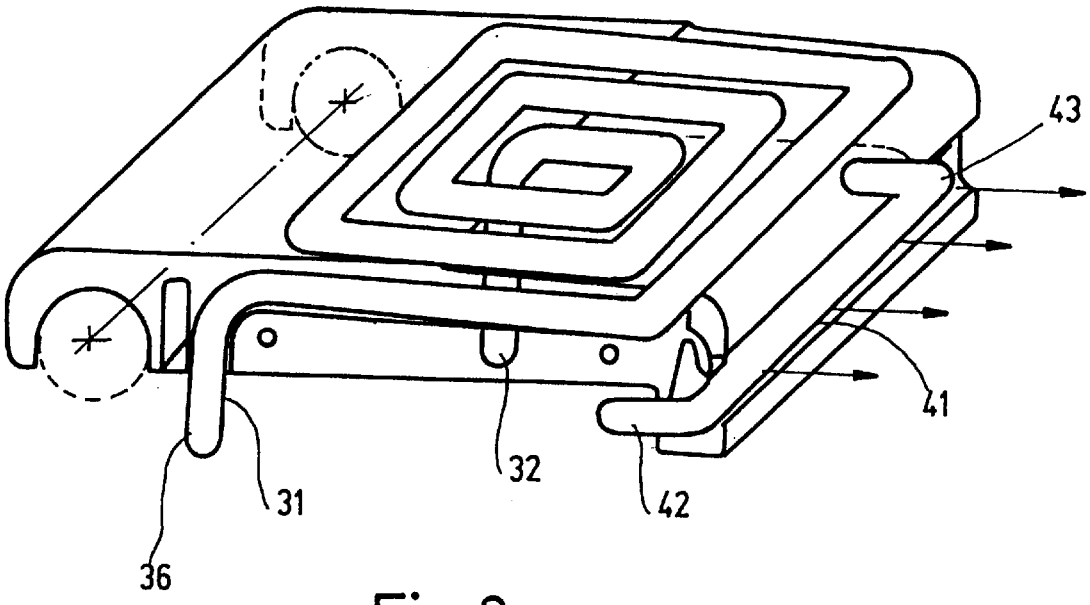
FIG. 3 is a schematic, perspective view of the grate plate of FIG. 2, illustrating the cooling channels in the grate plate.

FIG. 1 shows part of a feed grate 1, positioned in the incineration chamber 2 of a trash incinerator (not shown in detail). The feed grate is made up of multiple, individual grate plates 3 several of which are arranged side-by-side in a direction perpendicular to the longitudinal direction 4 of the furnace. These grate plates 3 constitute a grate-plate group 5 and the feed grate 1 is comprised of several such successive grate-plate groups 5 plus 6, 7 and additional grate-plate groups not illustrated in FIG. 1.

Figure 5:
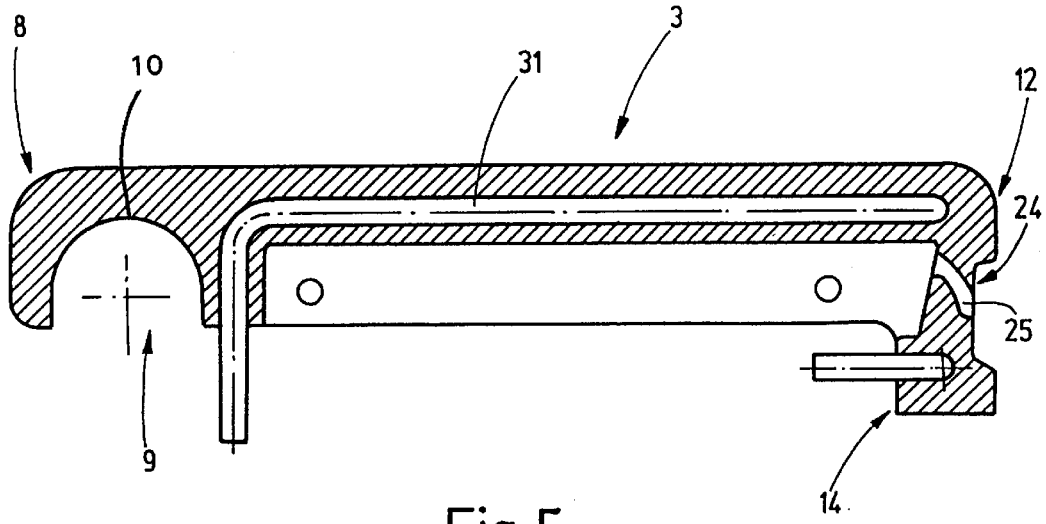
FIG. 5 shows a cross section of the grate plate taken along line V—V of FIG. 4.

At their upstream end 8, as related to the longitudinal direction 4 of the furnace, the grate plates 3 of plate group 5 are provided with a horizontal recess 9, more clearly shown for instance in FIG. 5, that opens toward the bottom and is equipped on both sides of the grate plate 3 with mouth-shaped seats 10. These seats 10 act as a connecting element such that the seats 10 sit on a grate-plate carrier element that may be for instance in the form of a round rod 11 extending across the entire width of the feed grate 1. At its opposite end 12, each grate plate 3 is provided with a foot strip 14 that serves as a sliding support for the grate plate 3. As can be seen in FIG. 1, the foot strip 14 rests on the respective grate plate 3*a* of the grate-plate group 6 that follows. The grate plate 3*a* thus forms a countersupport for the grate plate 3. The grate plate 3*a* which, like all other grate plates, is identical to the grate plate 3 the description of which applies to all of the grate plates, has its horizontal recess 9 anchored on a rod 15 which extends across the entire width of the feed grate 1 parallel to the first rod 11.

Figure 8:
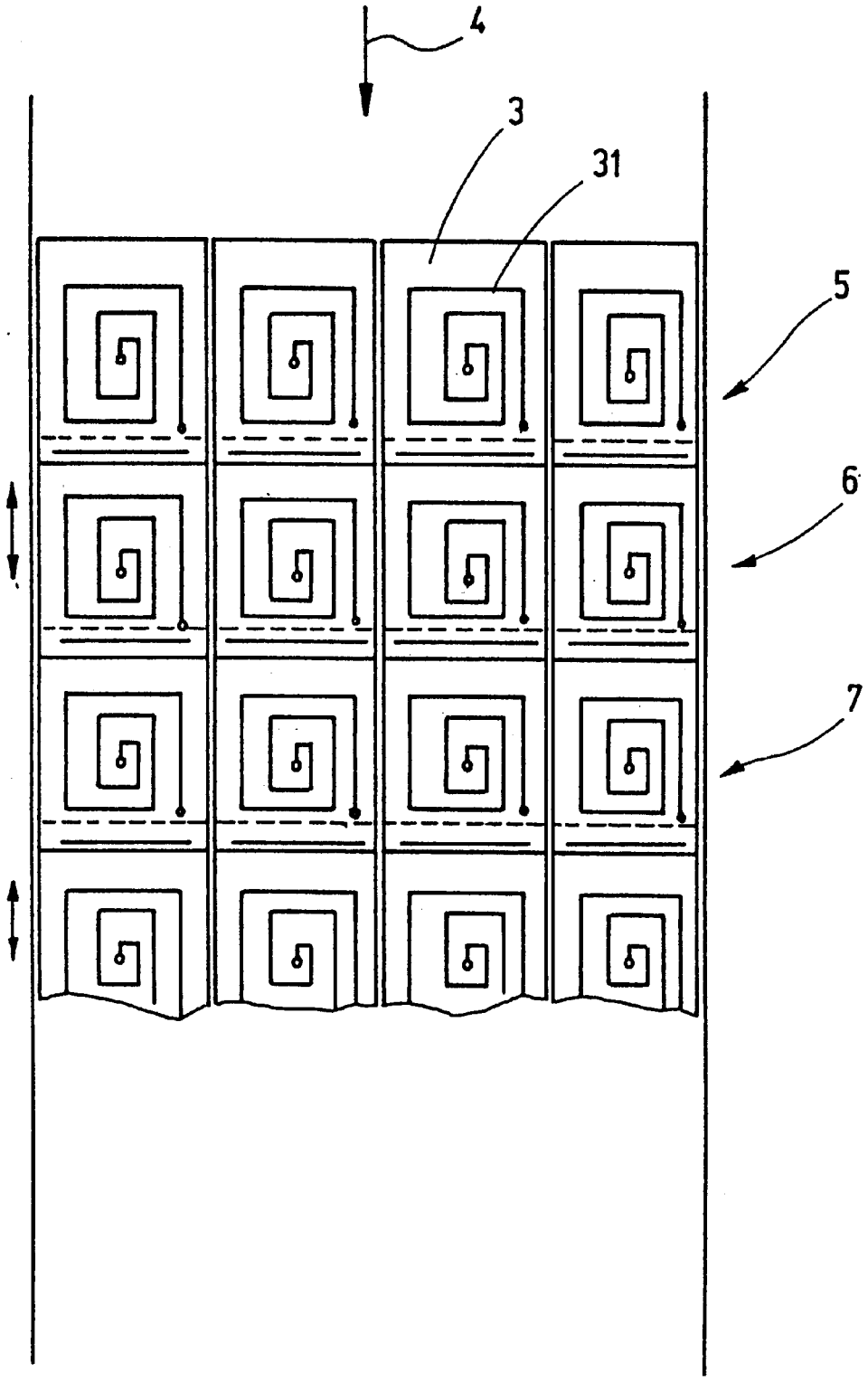
FIG. 8 is a schematic top view of the feed grate of FIG. 1, showing the cooling channels of the individual grate plates.

Additional rods 16, distributed over the entire length of the feed grate 1, extend in the horizontal direction. Every other such rod is mounted in fixed position. The rods in between are connected to a drive system which causes each corresponding rod to oscillate back and forth in the direction of the longitudinal orientation 4 of the furnace, as indicated for the grate-plate group 3 by the arrows 17 and 18 in FIG. 1. The result is a staircase-type feed grate 1 whose grate-plate groups 5, 6, 7 are stepped in staircase fashion, with every other grate-plate group (6) oscillating back and forth in order to move the material to be incinerated in the feed direction 4 of the furnace. FIG. 8 represents a top view of this feed grate.

The design of each individual grate plate 3 is most clearly shown in FIGS. 2 to 5. The grate plate 3 is a cast-metal body which defines the shape of a grate unit 21, the top side 22 of which is an essentially flat, rectangular surface that accepts the material to be incinerated. The rearward end 8 and the forward end 12 of the grate unit 21 are slightly rounded. Slots 25 admitting combustion air open up into a horizontal groove 24 provided between the rounded edge at the forward end 12 and the foot strip 14. These air slots 25 are most clearly shown in FIG. 5. The air slots 25 connect the combustion chamber 2 with the area underneath the feed grate 1 to which preheated combustion air is fed. The air slots 25 are the only connection between the area underneath the grate 1 and the combustion chamber 2. Neighboring grate plates 3 are connected to one another in largely air-tight fashion.

During operation, the grate plates 3 are exposed to considerable heat. To prevent these grate plates 3 from overheating during operation as a result of the incineration of the material carried by them, each grate plate 3 is provided with a cooling channel 31. This cooling channel 31 serves to cool the top surface of the grate plate 3 and is thermally connected with it. As can be seen especially in FIG. 4, the cooling channel 31 originates from a first, centered coolant port 32 that is accessed from the underside of the grate unit 21. Connected to this coolant port is a conduit, not shown, which feeds or withdraws the coolant. This conduit is flexible or articulated if the grate plate 3 to which it is connected is a moving plate.

Figure 4:
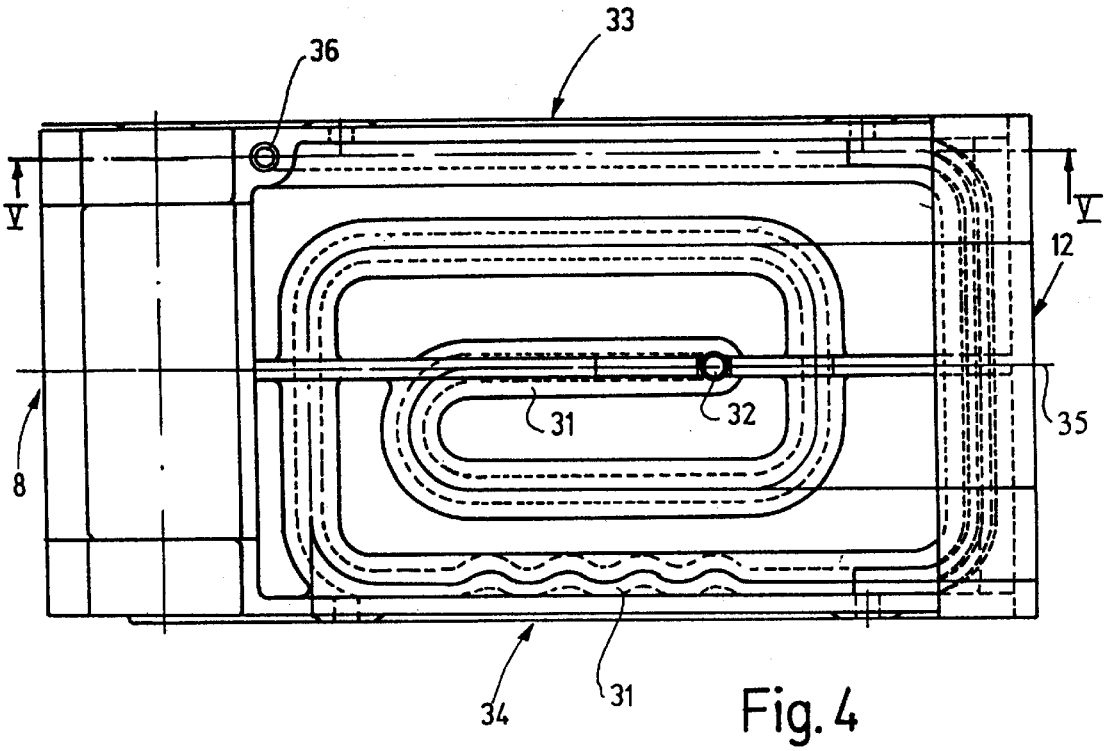
FIG. 4 is a schematic top view of the grate plate of FIGS. 2 and 3.

As can be seen in FIG. 4, the coolant port 32 is centered between the two sides 33, 34 of the grate unit 21. Along an imaginary center line 35 the coolant port 32 is positioned more closely to the forward end 12 than to the rearward end 8.

Originating from the coolant port 32, the cooling channel 31 follows several loops and terminates in a second coolant port 36 located next to the side 33. Along its path, the cooling channel 32 circles the central coolant port 32 in an unchanging direction. Therefore, independent of any actual length or width of the grate unit 21, it is laid out as a spiral and in particular a rectangular spiral, the windings or loops of which are in one common plane and thus equidistant from the top surface 22.

To obtain uniform temperature distribution on the top surface 22 the grate unit 21, these loops may be positioned at varying distances from the top surface 22. For example, it is possible to place the coolant port 32 or 36 or the channel loops connected thereto somewhat farther away from the top surface 22. The loops will then no longer extend in one common plane but may lie for instance on the envelope of a flat cone.

As can be seen especially in FIG. 4, individual segments 31' of the cooling channel 31 may follow a wavy pattern so as to further improve the thermal transition. This wavy pattern may be used either for only a few individual segments 31' or for the entire cooling channel 31.

The cooling channel may be formed by means of a cored die at the time the grate unit 21 is cast. However, a particularly inexpensive and reliable approach consists in first producing the cooling channel as a tubular structure tailored to the shape of the grate unit 21 to be cast and then casting the molten metal, preferably steel, around the channel structure to form the grate unit 21. For the channel piping any conventional material may be used (steel or other metals). This method will establish a close bond, with a good thermal transfer coefficient, between the channel tubing and the grate unit 21.

At the forward end 12 of the grate unit 21 the temperatures will be relatively high. This is true especially in the vicinity of the horizontal groove 24. In order to prevent overheating, an additional, horizontal cooling channel 41 is provided which has two coolant ports, 42 and 43, of its own. The cooling channel 41 is used exclusively for the focused cooling of the forward end section of the grate unit 21, allowing for a separate, controlled supply of cooling water.

If the grate plate 3 as a whole is to be operated at a higher temperature, the cooling water is first passed through the cooling channel 41. If the grate plate 3 is to be operated at a lower temperature, the cooling water will first be directed through the channel 31, preferably fed in through the coolant port 32. There are many possibilities of interlinking the cooling channels 31, 41 within each of the grate plates 3 and between the grate plates 3.

Figure 9:
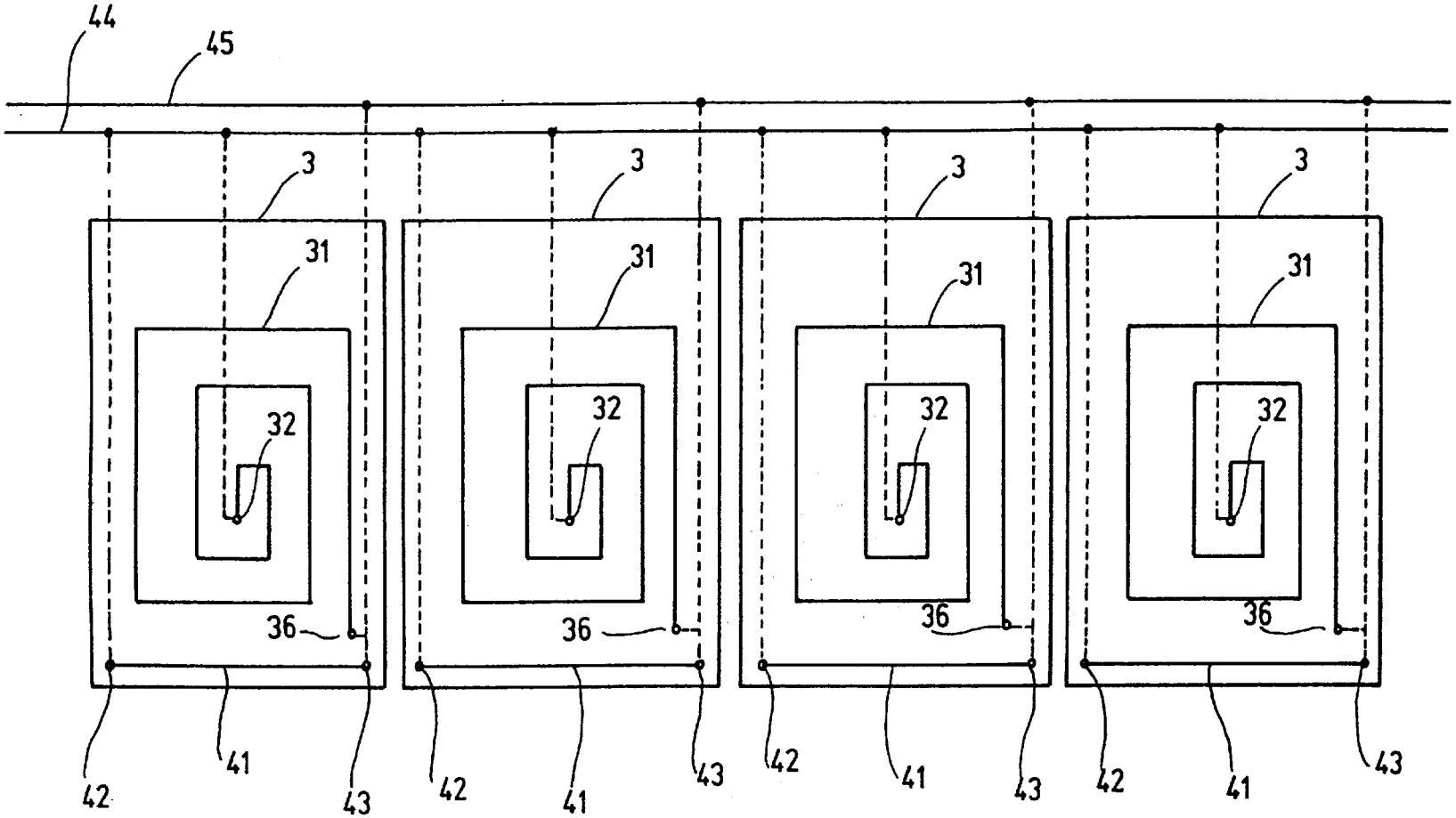
FIG. 9 is an enlarged schematic view of a group of the grate plates of FIG. 8, with an individual coolant supply for each plate.

The individual grate plates 3 of the feed grate 1 may be connected to separate coolant supplies, as shown for instance in FIG. 9. By way of appropriate feeders, a supply line 44 is connected to the ports 32, 42 serving as intakes for the cooling channels 31, 41. Heated cooling water exiting from ports 36 and 43 plate by plate is directed into a return line 45. The result is a very effective cooling of the grate plates 3. This cooling concept may be particularly useful for extra hot sections of the feed grate 1.

Figure 11:
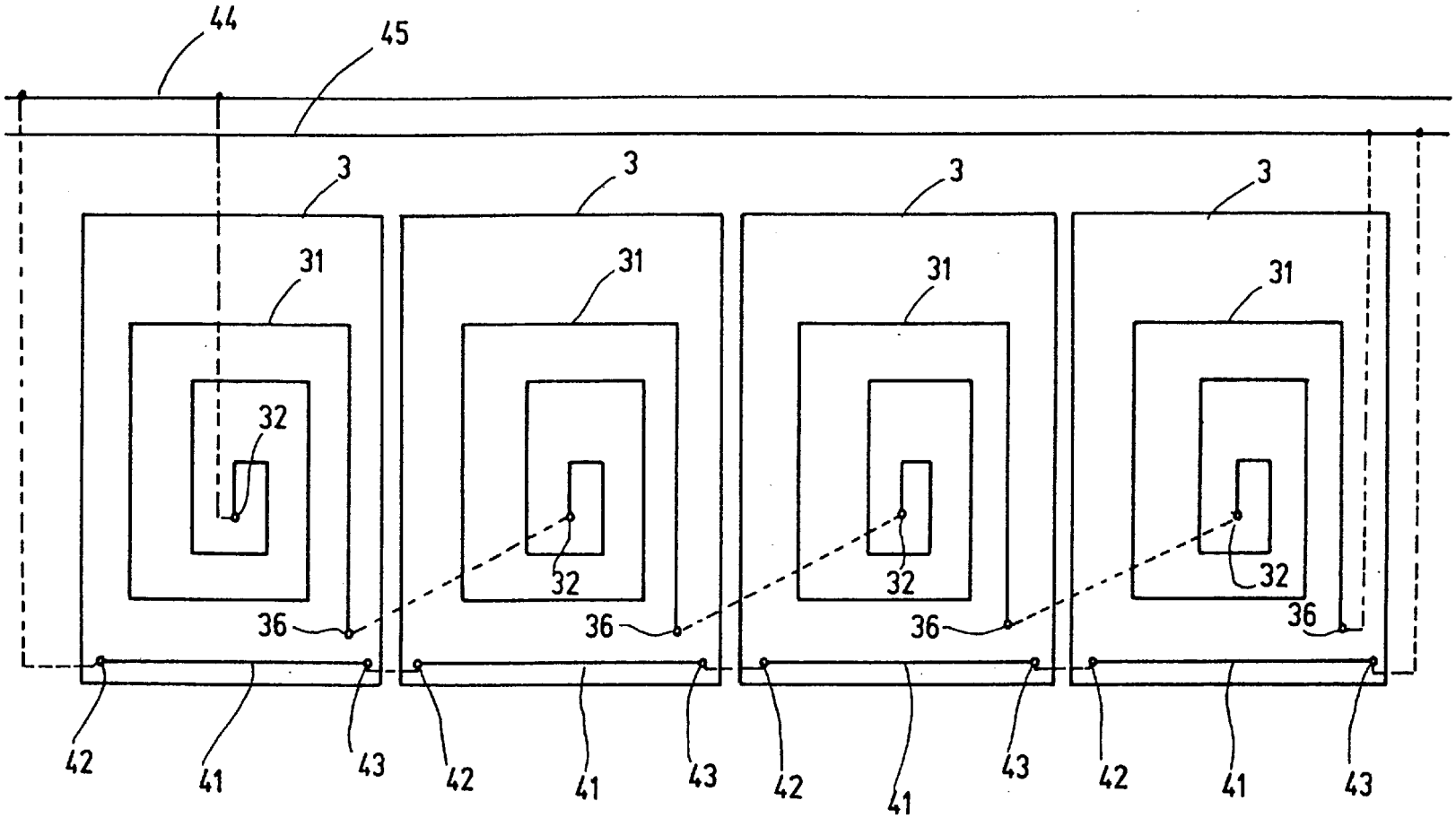
FIG. 11 is a schematic view of an enlarged schematic view of a group of the grate plates of FIG. 8, with forward and rearward cooling channels connected in series by groups.

If uneven plate temperatures are acceptable, the same coolant may be used, in a variety of configurations, to sequentially flow through the grate plates when connected in series. An example of this is shown in FIG. 11. This solution is particularly suitable for grate sections not exposed to very high temperatures.

Figure 10A:
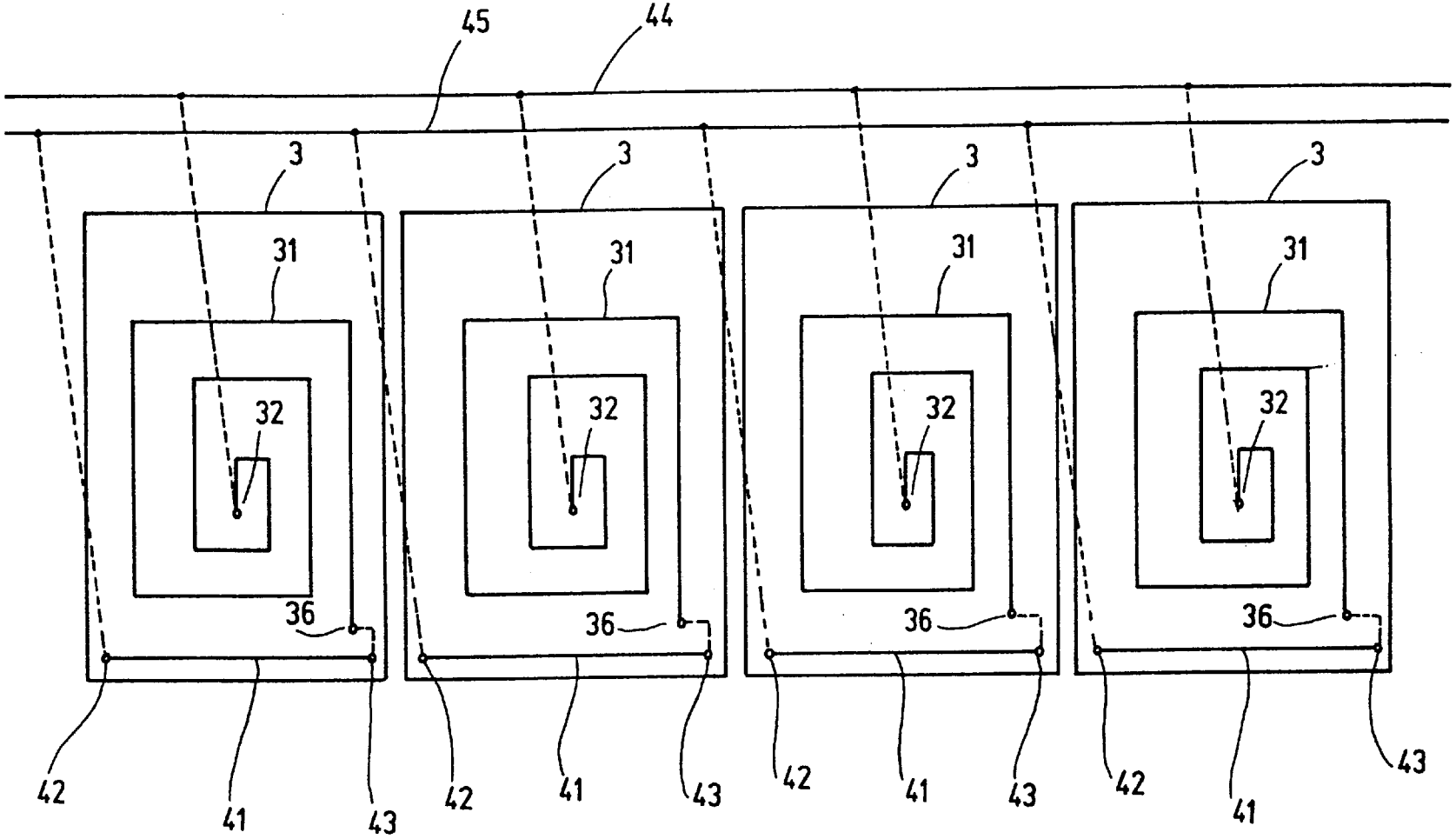
FIG. 10*a* is an enlarged schematic view of a group of the grate plates of FIG. 8, with cooling channels connected in series plate by grate plate and with the coolant intake at the plate center.
Figure 10B:
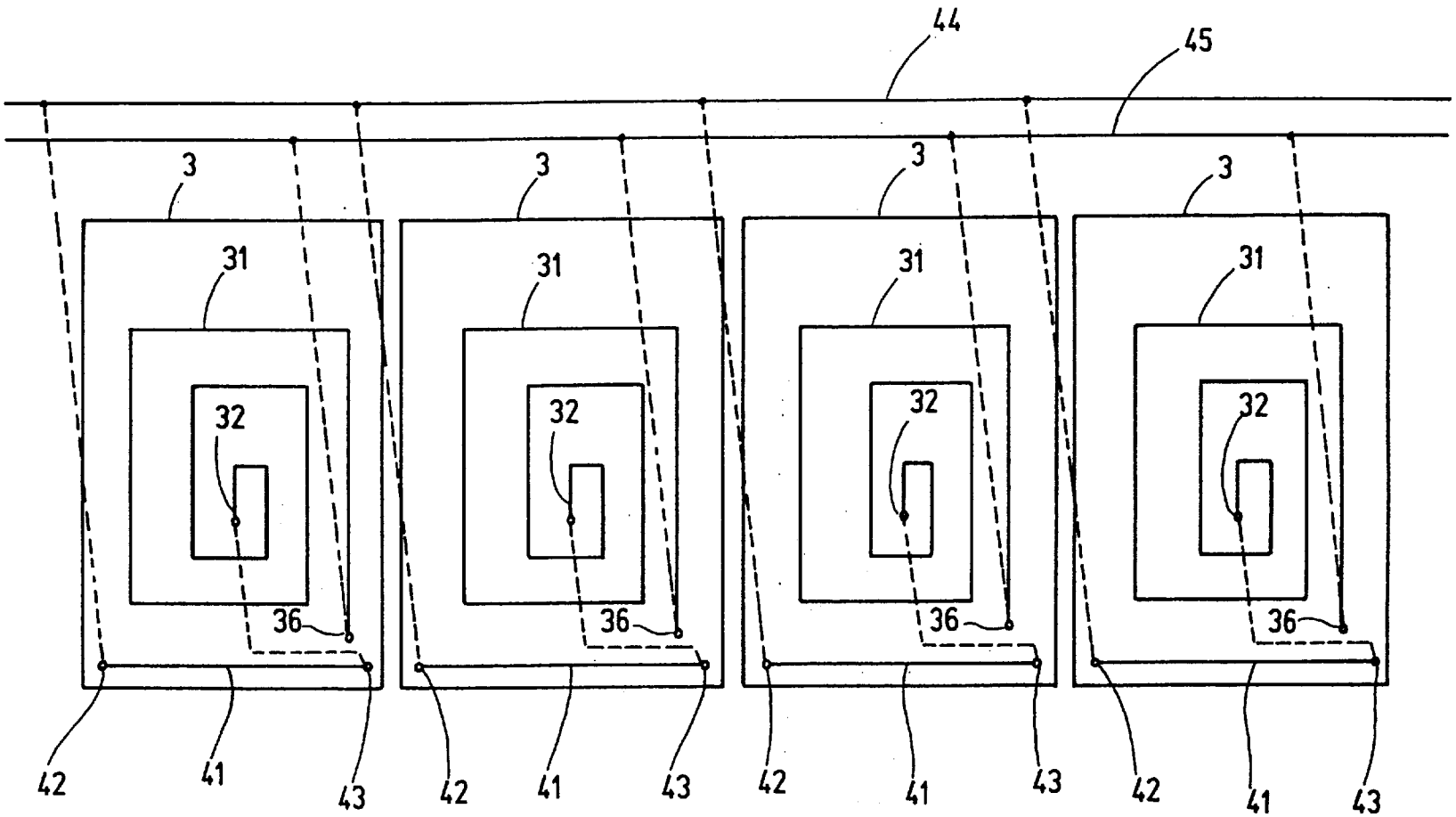
FIG. 10*b* is an enlarged schematic view of a group of the grate plates of FIG. 8, with cooling channels connected in series plate by grate plate and with coolant intake via a front-face cooling channel.

Accordingly, the cooling channels 31, 41 may also be series-connected plate by plate, as shown in FIG. 10*a* and 10*b*. The coolant intake from the supply line can take place via the port 32 (FIG. 10*a*) if cooling emphasis is on the top surface 22. If cooling is primarily required in the front section, port 42 serves as the intake for the coolant (FIG. 10*b*). If necessary, the coolant can be introduced via port 36. This is not illustrated in the figures, but it would correspond to FIG. 10*b* with the supply and return lines switched.

Figure 12:
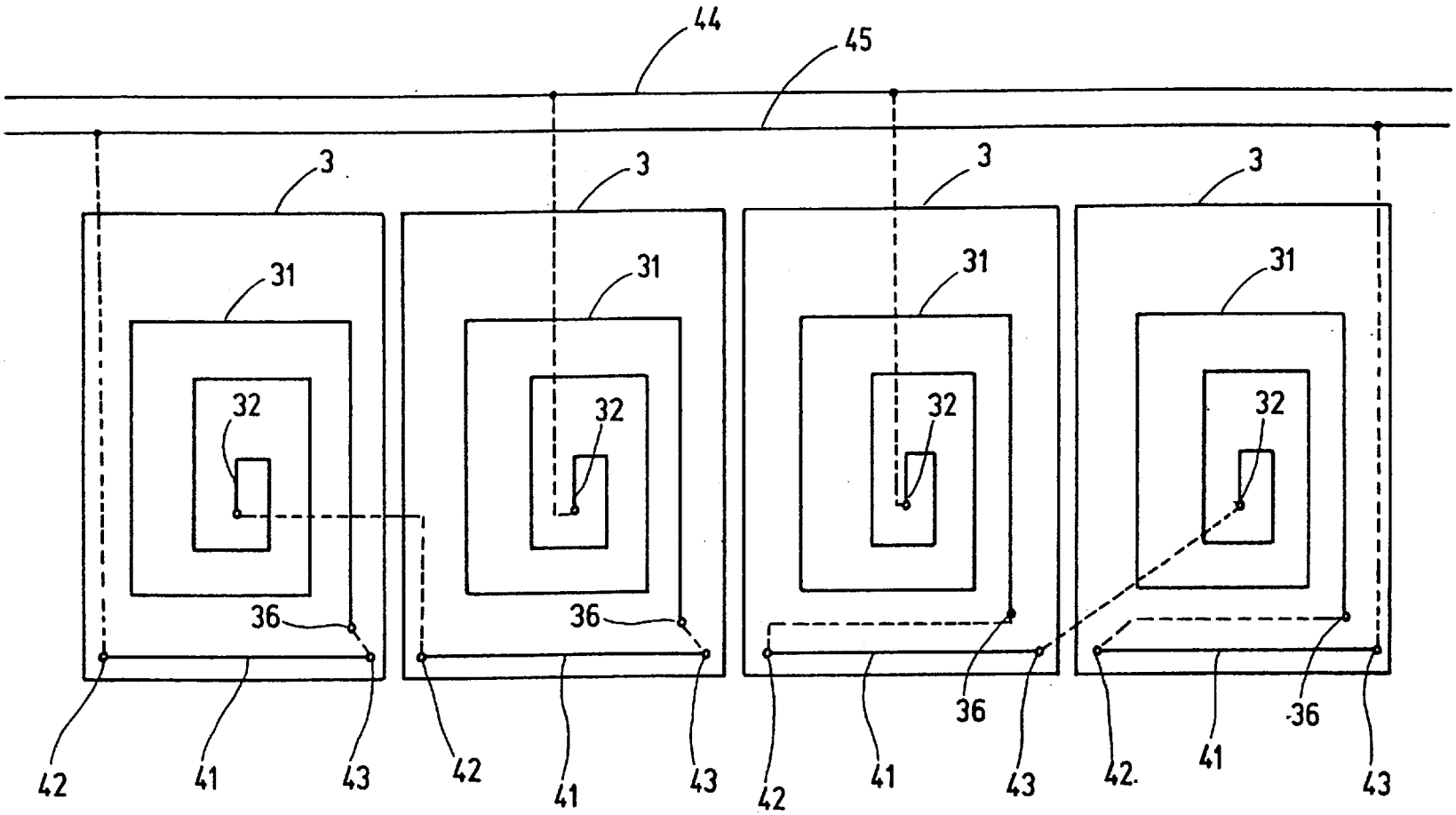
FIG. 12 is a schematic view of an enlarged schematic view of a group of the grate plates of FIG. 8, with cooling channels connected in series plate by grate plate and with series-connection of the cooling channels of selected grate plates.

FIG. 12 shows a configurational variation of the cooling channels 31, 41, whereby the cooling channels 31, 41 for each of the grate plates 3 are connected in series. In addition, several other grate-plate combinations are respectively connected in series. There is a fixed flow sequence through the grate plates 3 from the center of the grate to the sides. The coolant first flows through the hotter central grate plates and then through the peripheral zones of the grate plates 3.

An appropriate selection and/or combination of cooling-system variants permits good adaptation to various conditions and operational requirements or in different sections of the grate. If required by the thermal load, any of the cooling configurations illustrated in FIGS. 9 to 12 may be used with the supply and return lines reversed.

During operation, solid materials to be incinerated, such as trash, is placed on the feed grate 1. Every other group 6 of grate plates oscillates back and forth (arrows 17, 18). Combustion air flows through the air slots 25 into the combustion chamber 2. Cooling water flows through the cooling channels 31, 41. In this case, the flow direction through the cooling channel 41 is horizontal, i.e. perpendicular to the longitudinal direction 4 of the furnace. The cooling channel 31 produces a circulating flow, whereby the cooling water flows from the coolant port 32 through several loops radially toward the perimeter until it arrives at and exits from the coolant port 36. The flow rate in the circumferential direction is relatively strong compared to the slower flow of the radial component. The relatively rapid circumferential flow rate along the essentially spiral path of the cooling channel 31 produces a fairly uniform temperature distribution pattern. Independent of the radial direction, nearly identical temperatures are obtained at matching distances from the coolant port 32. It follows that the temperatures on both sides, 33 and 34, are the same. There is no temperature gradient from one side of the grate unit 21 to the other.

Figure 6:
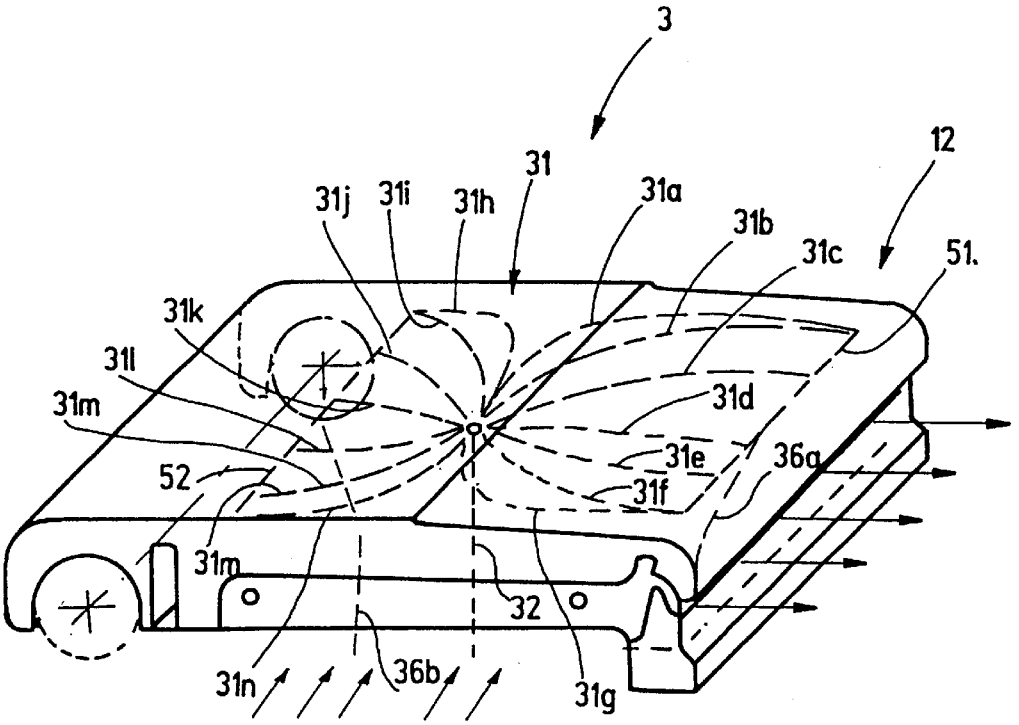
FIG. 6 is a schematic, perspective view of a second embodiment of a grate plate according to this invention.
Figure 7:
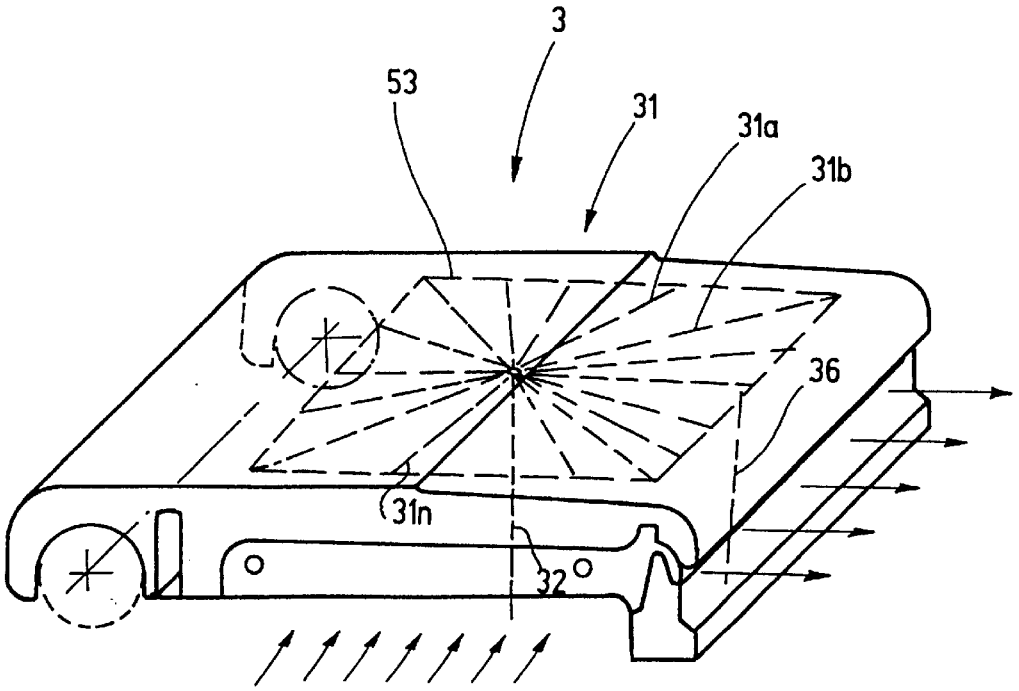
FIG. 7 is a schematic, perspective view of a third embodiment of a grate plate according to this invention.

FIGS. 6 and 7 illustrate alternative design implementations of the grate plate 3. In the grate plate 3 per FIG. 6, the cooling channel 31 emanating from the coolant port 32 is subdivided into subchannels 31*a*, 31*b* . . . 31*n*. These extend in an initially star-shaped pattern away from the coolant port 32 and then turn towards a manifold 51 horizontally positioned at the forward end 12 of the grate plate 3 and provided with a coolant port 36*a*. The subchannels 31*h* to 31*n* follow a curved line to a manifold 52 which leads to a coolant port 36*b*.

Other than that the grate plate 3 per FIG. 6 is identical to the grate plate 3 described further above, offering the same features.

A central coolant inlet/outlet port is also provided on the grate plate 3 illustrated in FIG. 7. Starting at the first coolant port 32, the cooling channel 31 branches out into multiple subchannels 31*a* to 31*n* radially extending away from the coolant port 32. At their ends next to the plate perimeter these subchannels connect to a circumferential manifold 53 which has one or several coolant ports 36. The subchannels may be positioned on one identical plane or on the envelope of a flat cone. Their diameters may vary depending on their respective length.

A water-coolable grate plate 3, especially when used in a trash incinerator, will have at least one cooling channel 31 which serves to cool the top surface 22 of the grate plate 3. The cooling channel 31 will have a coolant port 32 provided in a central location of the grate plate 3. It is important that the coolant port 32 be essentially centered between the sides 33, 34 of the grate plate 3 while it may be positioned closer to either the rearward end 8 or the forward end 12 of the grate plate 3.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A feed grate including a grate plate carrier and a plurality of grate plates each grate plate comprising:

oppositely disposed top and bottom surfaces;

oppositely disposed first and second ends;

oppositely disposed first and second sides defining a centerline; therebetween a cooling system including a cooling channel and at least a first coolant port located at centerline and positioned at the bottom surface of the grate plate, the first coolant port being in fluid communication with the cooling channel and adapted for connection to a conduit; and a top surface extending from the first side to the second side for holding solid materials to be incinerated, the top surface being thermally connected with the cooling channel wherein the grate plates are positioned first end to second end in overlapping fashion, one behind the other.

2. The grate plate of claim 1, further comprising a connecting element engageable with the grate plate carrier.

3. The grate plate of claim 2, further comprising oppositely disposed first and second ends and an underside defining a recess adjacent the first end and extending from the first side to the second side, the recess forming the connecting element, the grate plate carrier being receivable within the recess.

4. The grate plate of claim 3, further comprising a sliding support element disposed adjacent the second end of the grate plate.

5. The grate plate of claim 4, wherein the first coolant port of the cooling channel is positioned at a distance from the first and second ends of the grate plate, the distance from the first end not being equal to the distance from the second end.

6. The grate plate of claim 1, wherein the cooling channel extends from the first coolant port to a second coolant port, the second coolant port being positioned at a distance from the first coolant port.

7. The grate plate of claim 6, wherein the second coolant port is located adjacent one of the sides of the grate plate.

8. The grate plate of claim 6, further comprising oppositely disposed first and second ends, the second coolant port being located adjacent one of the ends.

9. The grate plate of claim 6, wherein the cooling channel has a cross section that varies between the first and second coolant ports.

10. The grate plate of claim 6, wherein one of the first and second coolant ports is a coolant intake and the cooling channel has a cross section which is larger adjacent the coolant intake than it is adjacent the other of the first and second coolant ports.

11. The grate plate of claim 1, wherein the cooling channel extends in a plane which is substantially parallel with the top surface.

12. The grate plate of claim 1, wherein the cooling channel originates from the first port and follows a spiraling path along at least one loop.

13. The grate plate of claim 12, wherein the spiraling path of the cooling channel includes several loops.

14. The grate plate of claim 12, wherein the loop includes at least one straight or undulating section.

15. The grate plate of claim 14, wherein the loop is essentially rectangular.

16. The grate plate of claim 1, wherein the cooling channel has a length and a cross section that remains constant over the entire length of the cooling channel.

17. The grate plate of claim 1, wherein the cooling system further includes an additional cooling channel.

18. The grate plate of claim 17, further comprising oppositely disposed first and second ends and a sliding support element disposed adjacent the second end, the additional cooling channel being positioned near the sliding support and extending from the first side to the second side.

19. The grate plate of claim 18, wherein the additional cooling channel and the cooling channel are connected in series or parallel.

20. The grate plate of claim 19, wherein the cooling channels of each grate plate are connected with the cooling channels of each grate plate positioned to either of the sides of the grate plate.

21. The grate plate of claim 1 being composed of cast metal formed in a casting.

22. The grate plate of claim 21, wherein the cooling channel consists of piping encapsulated in the casting of the grate plate.

23. The grate plate of claim 21, wherein the cooling channel is formed by a cavity in the casting of the grate plate.

24. The grate plate of claim 1, wherein the grate plate consists of one single piece.

25. The grate plate of claim 1, wherein the grate plate comprises a multi-part assembly.

26. A feed grate comprising a plurality of grate plates, and grate plate carriers each grate plate having:

oppositely disposed top and bottom surfaces;

oppositely disposed first and second sides defining a centerline; therebetween a cooling system including a cooling channel and at least a first coolant port located at the centerline and positioned at the bottom surface of the grate plate, the first coolant port being in fluid communication with the cooling channel and adapted for connection to a conduit; and a top surface extending from the first side to the second side for holding solid materials to be incinerated, the top surface being thermally connected with the cooling channel and, each grate plate carrier extending from the first side to the second side of each one of the grate plates.

27. A feed grate including a plurality of grate plates, each grate plate comprising:

oppositely disposed top and bottom surfaces;

oppositely disposed first and second sides;

a cooling system including a cooling channel extending from a first coolant port to a second coolant port, the first coolant port being positioned at the bottom surface of the grate plate, the second coolant port being positioned at a distance from the first coolant port, the cooling channel having a cross section that varies between the first and second coolant ports; and a top surface extending from the first side to the second side for holding solid materials to be incinerated, the top surface being thermally connected with the cooling channel.

28. A feed grate including a plurality of grate plates, each grate plate comprising:

oppositely disposed top and bottom surfaces;

oppositely disposed first and second sides;

a cooling system including a cooling channel extending from a first coolant port to a second coolant port, the first coolant port being positioned at the bottom surface of the grate plate, the second coolant port being positioned at a distance from the first coolant port, one of the first and second coolant ports being a coolant intake and the cooling channel having a cross section which is larger adjacent the coolant intake than it is adjacent the other of the first and second coolant ports; and a top surface extending from the first side to the second side for holding solid materials to be incinerated, the top surface being thermally connected with the cooling channel.

29. A feed grate including a plurality of grate plates, each grate plate being composed of cast metal formed in a casting and comprising:

oppositely disposed top and bottom surfaces;

oppositely disposed first and second sides:

a cooling system including a cooling channel and at least a first coolant port positioned at the bottom surface of the grate plate, the first coolant port being in fluid communication with the cooling channel and adapted for connection to a conduit; and a top surface extending from the first side to the second side for holding solid materials to be incinerated, the top surface being thermally connected with the cooling channel.

* * * * *